United States Patent [19]

Kato

[11] Patent Number: 4,953,599

[45] Date of Patent: Sep. 4, 1990

[54] METHOD OF GRIPPING A STRAP FOR BONDING THE STRAP END PORTIONS TO EACH OTHER

[75] Inventor: Kanami Kato, Sakai, Japan

[73] Assignee: Signode Corporation, Glenview, Ill.

[21] Appl. No.: 380,490

[22] Filed: Jul. 17, 1989

[51] Int. Cl.[5] ..... B21F 15/06

[52] U.S. Cl. ..... 140/93.4; 100/30

[58] Field of Search ..... 140/93.2, 93.4; 100/29, 100/30, 32; 24/DIG. 22

[56] References Cited

U.S. PATENT DOCUMENTS 2,854,035 9/1958 Moberg ..... 140/93.4

FOREIGN PATENT DOCUMENTS 385725 3/1965 Switzerland ..... 140/93.4

2118265 10/1983 United Kingdom ..... 100/32

*Primary Examiner*—Lowell A. Larson

*Attorney, Agent, or Firm*—Schwartz & Weinrieb

[57] ABSTRACT

A method of gripping a leading end portion of a binding strap so as to facilitate the bonding of strap end portions to each other, and apparatus therefore, includes the provision of a movable jaw and a stationary cutter wherein the jaw and cutter are provided with convex and concave portions which intermesh with each other with the convex portions of the jaw and cutter being substantially longitudinally aligned or disposed opposite the concave portions of the other. In this manner, the strap portion being gripped is gripped in an undulated or corrugated manner so as to insure secure gripping thereof even under high-tension, high-torque conditions, such as, for example, as the binding strap is being tightened and tensioned in preparation for the bonding operation of the overlapped leading and trailing end portions of the binding strap encircling the article being bound.

6 Claims, 3 Drawing Sheets

FIG. 1
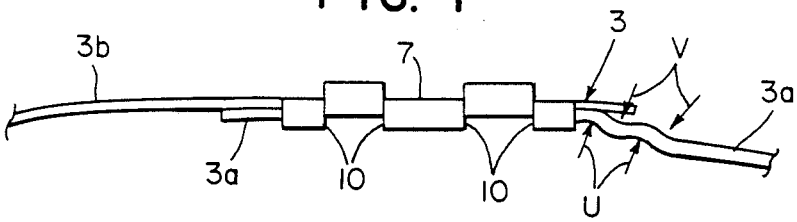
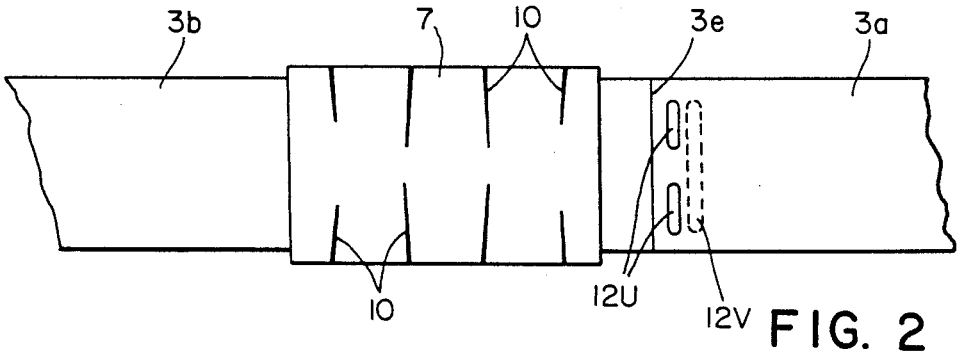
FIG. 2
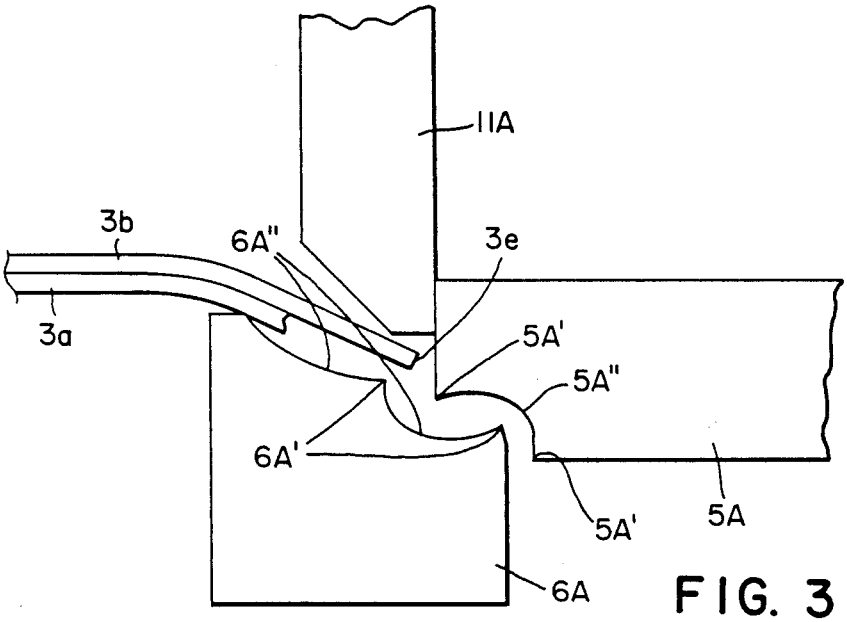
FIG. 3

FIG. 4
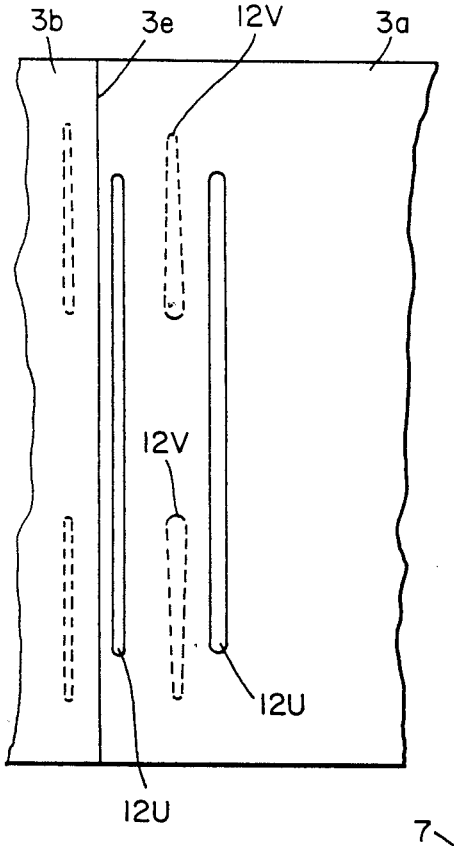
FIG. 5 (PRIOR ART)
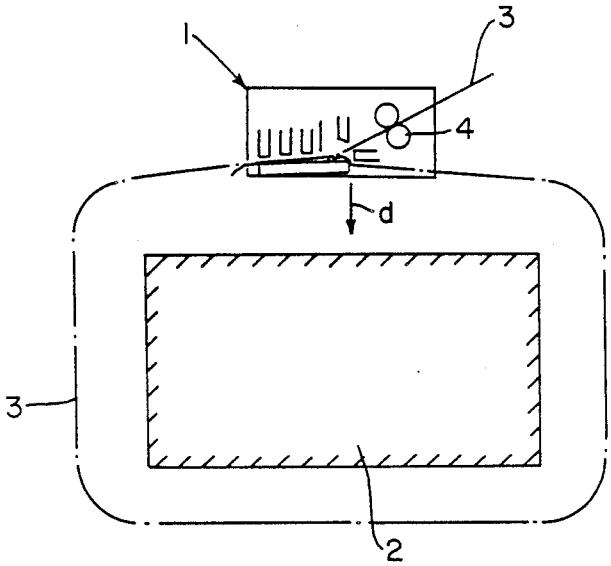
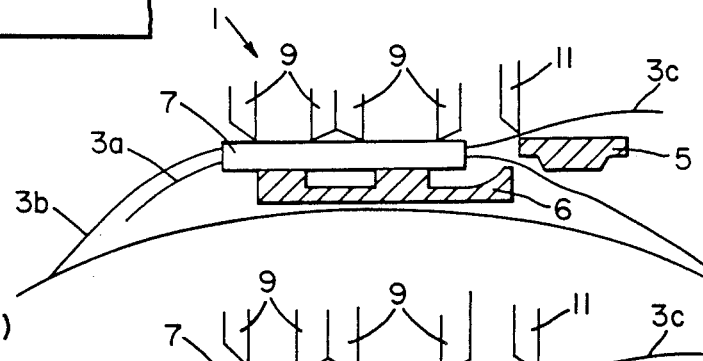
FIG. 6a
(PRIOR ART)
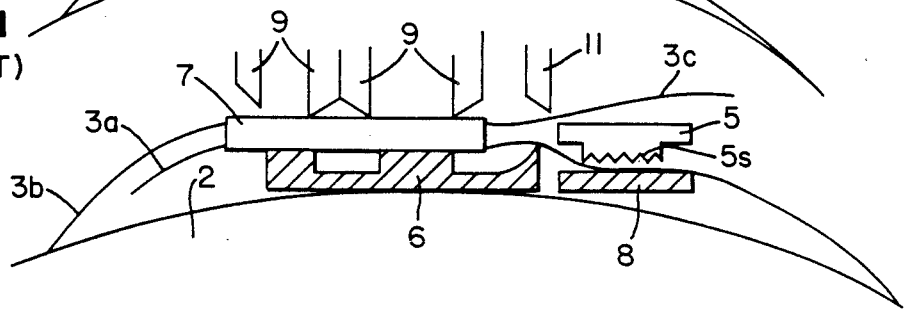
FIG. 6b
(PRIOR ART)

FIG. 7a (PRIOR ART)
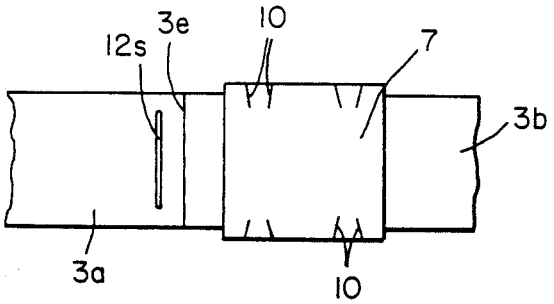
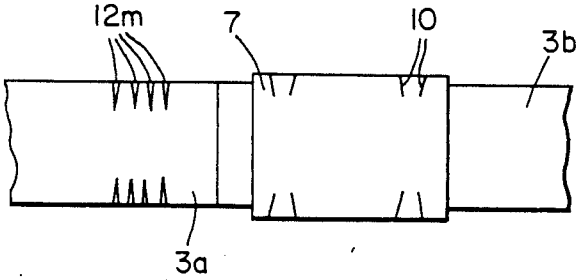
FIG. 7b (PRIOR ART)

METHOD OF GRIPPING A STRAP FOR BONDING THE STRAP END PORTIONS TO EACH OTHER

FIELD OF THE INVENTION:

The present invention relates generally to the field of binding articles by means of a tensioned encircling binding strap, such as, for example, a steel band, and more particularly to improvements in a method, and a means for carrying out the method, of securing and holding a portion of the binding strap, which is disposed upstream of the leading end portion of the strap which is to be overlapped with respect to a trailing end portion of the binding strap so as to be bonded thereto, as the trailing end portion of the binding strap is retracted, tightened, and tensioned, by means of reversely driven driving rollers in preparation for the bonding operation.

BACKGROUND OF THE INVENTION:

With reference initially being made to FIGS. 5–7 of the drawings, a conventional strap binding method, and the apparatus operatively provided for carrying out the method, for binding articles to be bound by means of an encircling tensioned steel band or strap, will first be described in order to provide a brief descriptive foundation of typical binding methods and apparatus normally employed within the above-identified technological field in connection with which the present invention comprises improvements thereover.

As can best be appreciated from FIG. 5, a conventional binding apparatus includes a multi-functional binding head 1 which is vertically movable with respect to a support frame, not shown, of the apparatus. Articles 2 to be bound by means of an encircling binding strap 3 are conveyed to a predetermined position beneath the binding head 1. The binding strap 3, which is, for example, a steel band, is fed from a suitable dispenser or supply means, not shown, by means of a forward rotational drive operation of reversible-feed rollers 4 which are also disposed within the binding head 1. The strap 3 is guided around the articles 2 to be bound through means of a chute and a gate, both not shown, and after encircling the articles 2 to be bound, the leading end 3*a* of the strap 3 re-enters the binding head 1 in preparation for a bonding operation with respect to the succeeding or trailing end portion 3*b* of the strap 3 whereby the encircling band or strap can be properly tensioned and secured about the article 2 being bound.

More particularly, when the leading end portion 3*a* of the strap 3 re-enters the binding head 1 and is disposed beneath the succeeding or trailing end portion 3*b* of the strap 3 as illustrated in FIG. 6(*a*), a stationary cutter 5 and a jaw 6, which is movable relative to stationary cutter 5, are closed with respect to each other so as to intermesh with each other and thereby securely grip an upstream portion of the leading end portion 3*a* of the strap 3. When the leading end portion 3*a* of the strap 3 is therefore securely gripped, the drive rollers 4 are rotated in their reverse mode so as to thereby take-up or retract the residual or trailing end portion 3*b* of the strap 3. As a result of such reverse rotation or retraction operation performed upon the trailing end portion 3*b* of the strap 3, the latter is effectively removed from the chute and gate, not shown, such that the article 2 to be bound has the binding strap 3 tightened thereabout. At the same time, the binding head 1 is lowered onto, or into engagement with, the article 2 to be bound a illustrated by means of the arrow d shown in FIG. 1.

While increased tension is being applied to the binding strap 3 by means of the high-torque reverse rotation of the drive rollers 4, a sealing fitment or crimped ferrule is secured upon the overlapped portions of the leading end portion 3*a* of the strap 3 and the trailing end portion 3*b* of the strap 3 as shown at 7 in FIGS. 6 and 7. The aforenoted crimping operation is achieved by means of the relative cooperation defined between jaw 6 and vertically movable notchers or crimping mechanisms 9. As can be readily appreciated from FIGS. 6(*a*) and 6(*b*), the crimping mechanisms 9 comprise downwardly extending prongs, teeth, or blade members which are laterally spaced with respect to each other so as to correspond with similarly laterally spaced upstanding portions of jaw 6 whereby when the crimping mechanisms 9 and jaw 6 relatively approach each other, as a result of lowered movement of the mechanisms 9, the ferrule 7 will be crimped in an undulated or corrugated manner which, more particularly, define notched portions 10 upon the ferrule 7 as best seen in FIG. 7. These crimped or notched sections of the ferrule 7 are then calked such that the overlapped strap portions of leading end portion 3*a* and trailing end portion 3*b* of strap 3 are effectively bonded to each other. At the same time, the bonded strap portions are severed and separated with respect to the residual supply portion 3*c* of the strap 3 by means of stationary cutter 5 which operatively cooperates with a vertically movable cutter 11.

It is further noted that when the jaw 6, which serves as an underlay or underlying foundation for supporting the overlapped portions 3*a* and 3*b* of the strap 3, and the ferrule 7 disposed thereabout, so as to operatively cooperate with the crimping mechanisms 9, is transversely removed from its operative disposition relative to crimping mechanisms 9, the bonded strap 3 resiliently achieves a predetermined amount of looseness or slack generated as a result of such removal or withdrawal of the jaw 6. However, a sufficiently high amount of tension has in fact been imparted to the binding strap 3, by means of the high torque reversely driven rollers 4, and fixed therein by means of the aforenoted bonding process, that such predetermined amount of looseness or slack does not adversely or deleteriously affect the binding state of the strap 3 about article 2.

As set forth hereinabove, the conventional strap binding operation and apparatus has been described in accordance with the most commonly prevailing example or embodiment, however, the bonding means comprises a variety of different examples. For example, the overlapping strap portions may be bonded to each other by means other than the aforenoted seal fitment or crimped ferrule, such as, for example, by means of spot welding or similar techniques. Furthermore, the gripping means comprising stationary cutter 5 and movable jaw 6, as shown in FIG. 6(*a*), wherein the cutter 5 and jaw 6 define a single-planar or single-edge gripping means, may alternatively comprise multi-edge or multi-planar gripping means, such as, for example, disclosed in FIG. 6(*b*). More particularly, the binding strap 3 has a portion thereof disposed upstream of the leading end 3*a* thereof sandwiched between and gripped by means of a saw-tooth holding surface 5*s* of stationary cutter 5 which operatively cooperates with a flat surface portion 8 of the movable jaw 6.

Regardless of the particular type gripping means and/or bonding means or technique employed in connection with the strap binding process conventionally performed, the binding process always includes the basic serial steps of encircling the articles 2 to be bound by means of the binding strap 3; gripping the leading portion 3*a* of the binding strap once the strap has completely encircled the article 2 to be bound; taking up the trailing end portion 3*b* or the residual portion 3*c* of the binding strap by means of reverse rotation of the driving rollers 4; further tightening and tensioning of the binding strap by rotating the driving rollers 4 in their reverse mode under high-torque conditions; bonding the overlapping leading end and trailing end portions 3*a* and 3*b* of the strap 3 to each other under such tensioned conditions; cutting and separating the bonded strap 3 from the residual strap portion 3*c*; and removing the underlay 6.

In view of the foregoing, it is appreciated that in order to properly perform a strap binding operation, it is necessary to securely grip the leading end portion 3*a* of the strap 3 between the stationary cutter 5 and the jaw 6 so as to permit the same to assuredly resist or withstand the high tension imparted to the trailing end portion 3*b* of the strap 3 by means of the drive rollers 4 being driven in their reverse mode under high-torque conditions. In addition, it is also to be appreciated that even after the residual portion 3*c* of the binding strap 3 has been severed and separated from the trailing end portion 3*b*, or more particularly, from the bonded leading and trailing end portions 3*a* and 3*b*, the high degree of tension still remaining within the bound binding strap 3 still acts upon or is present within all portions of the bound binding strap 3. In particular, such high degree of tension acts upon a critical portion of the bound binding strap 3 which is defined between the bonding fitment 7 and the previously gripped portion of the strap 3 located upstream of the bonded section comprising overlapped strap portions 3*a* and 3*b*. Accordingly, the steel band strap 3 employed for such binding operations has sufficient tensile strength which is capable of adequately resisting such high degree of tension imparted thereto. For example, a conventionally used steel band strap may have a width dimension of 0.75–1.25 inches (19–32 mm), a thickness of 1 mm or less, and a tensile strength of approximately 75–100 kgs/mm$^2$.

Nevertheless, the strong aforenoted intermeshing gripping action defined between the stationary cutter 5 and the jaw 6 has its negative aspects in view of the fact that such gripping operation produces scars or grip marks upon the leading end portion 3*a* of the binding strap 3. For example, FIG. 7(*a*) shows a grip mark 12*s* which is produced by means of the ingle-gripping structure of FIG. 6(*a*), while FIG. 7(*b*) discloses grip marks 12*m* which are produced by means of the multiple gripping structure of FIG. 6(*b*).

Still further, if the gripping force achieved by the gripping means of either FIGS. 6(*a*) or 6(*b*) is less than the tightening tension applied to the strap 3 by means of the reversely driven driving rollers 4, the strap 3 will tend to slip within the gripped region thereof whereby the strap will experience cutting or tearing by means of the gripping means illustrated in either FIGS. 6(*a*) or 6(*b*). In addition, the residual binding tension will be substantially reduced.

Still yet further, in considering the single-gripping means of FIG. 6(*a*), it is appreciated that the single grip mark 12*s* is relatively large and deep. Accordingly, if an excessive amount of tension is applied to the binding strap so as to enhance the binding force thereof, the strap 3 may tear or be cut by the gripping means within the vicinity of the grip mark region thereof. In addition, due to the large size of the grip mark scar, there is an increased risk or possibility that the strap will be broken or partially torn if, for example, a bending force, or an external force in the shearing direction, is applied to the binding strap during, for example, transportation of the bound articles.

In a similar manner, considering the multiple-gripping means of FIG. 6(*b*), the gripping region is longitudinally extended along the longitudinal direction of the binding strap, and accordingly, the distance defined between the gripped portions of the strap 3 and the strap end portions 3*a* and 3*b* being bonded together by means of the seal fitment 7 or the like is increased as a direct function of the increased longitudinal extent of the the jaw portion 8 and the multiple-toothed cutter 5. Consequently, upon removal of the jaw portions 6 and 8 from beneath the bonded strap portions, substantial looseness or slack is developed or generated within the bound binding strap whereby the residual tension present within the binding strap is substantially decreased. Consequently, the use of such a multiple-gripping means when binding coil-like or small-sized articles is not practical since the aforenoted decrease in residual tension is disproportionately high. In addition, it is noted that the plurality of gripping locations must be equally arranged and that the gripping conditions attendant thereto be equalized. Consequently, abnormal free spaces, in the thickness direction of the binding strap, must be eliminated, and this objective requires precise adjustment or disposition of the strap portion to be gripped. Lastly, in view of the fact that such gripping means are longitudinally extended along the longitudinal direction of the binding strap, the size of the binding head is increased in size relative to, for example, a binding head employing a single-gripping means.

OBJECT OF THE INVENTION:

Accordingly, it is an object of the present invention to provide a new and improved gripping method, and apparatus for carrying out the same, which is capable of properly gripping the upstream portion of the leading end section of the binding strap while overcoming the aforenoted problems characterized in the prior art methods and apparatus.

SUMMARY OF THE INVENTION:

Accordingly, the foregoing and other objectives are achieved in accordance with the method of the present invention which includes the gripping of an upstream portion of the leading end section of the binding strap encircled about the article to be bound, while the overlapped leading and trailing end portions of the binding strap are bonded to each other, in such a manner that the aforenoted problems, defects, and deficiencies of the prior art or conventional methods and apparatus are effectively eliminated. More particularly, the method of the present invention comprises the conventional processing or operational steps of encircling the binding strap about an article to be bound by means of a suitable type of binding head of a binding apparatus; gripping a portion of the binding strap which is located upstream of the leading end portion of the strap so as to securely hold the same while the trailing end portion of the binding strap is taken-up or retracted by means of reversely driven drive rollers which initially tighten and then tension the binding strap; and bonding overlapping portions of the leading and trailing edge portions of the binding strap while the latter is maintained under the aforenoted high-tension conditions; however, the method of the present invention, and the apparatus for carrying out such method, additionally comprises the use of gripping means, including the stationary cutter and the movable jaw, wherein both the cutter and jaw are provided with intermeshing jaw or gripping surfaces which are defined by means of a plurality of concave and convex portions which are respectively disposed at opposed positions along the longitudinal extent of the binding strap, or considered alternatively, the respective convex and concave portions of the jaw and cutter are arranged in an alternative manner upon the jaw and cutter elements as one proceeds along the longitudinal extent of the binding strap. As a result of the provision of such convex and concave portions upon the cutter and jaw elements, the upstream portion of the leading end section of the binding strap is gripped in an undulated or corrugated manner whereby the deleterious effects of the prior art or conventional method and apparatus therefor are prevented, reduced, eliminated, or the like.

BRIEF DESCRIPTION OF THE DRAWINGS:

Various other objects, features, and attendant advantages of the present invention will become more apparent from the following detailed description, when considered in connection with the accompanying drawings, in which like reference characters designate like or corresponding parts throughout the several views, and wherein:

FIG. 1 is a side elevation view of the overlapped portions of the binding strap and with a bonding fitment or crimped ferrule secured thereon;

FIG. 2 is a plan view of the binding strap shown in FIG. 1 illustrating the grip marks achieved in accordance with the method and apparatus of the present invention;

FIG. 3 is cross-sectional view of the gripping means of the present invention as embodied upon the stationary cutter and movable jaw components of the binding head;

FIG. 4 is a plan view of the binding strap portion, disposed upstream of the leading edge portion of the binding strap, which is gripped by the gripping means of the present invention, and in accordance with the method thereof, illustrating the grip marks produced thereby;

FIG. 5 is a schematic side elevation view illustrating the conventional strap binding process;

FIG. 6(*a*) is a cross-sectional view illustrating a single-grip type gripping means constructed and used in accordance with the prior art;

FIG. 6(*b*) is a cross-sectional view illustrating a multiple-grip type gripping means constructed and used in accordance with the prior art;

FIG. 7(*a*) is a plan view of the binding strap portion gripped by means of the single-grip type gripping means of FIG. 6(*a*), showing the development or generation of the single grip mark or scar within the binding strap by means of the single-grip type gripping means of FIG. 6(*a*); and FIG. 7(*b*) is a plan view of the binding strap portion gripped by means of the multiple-grip type gripping means of FIG. 6(*b*) showing the multiple grip marks or scars developed or generated within the binding strap by means of the multiple-grip type gripping means of FIG. 6(*b*).

DETAILED DESCRIPTION OF THE ILLUSTRATED EMBODIMENTS:

Referring again to the drawings, and more particularly to FIGS. 1 and 3 thereof, the leading end portion 3*a* of the binding strap 3 is interposed between, and gripped by means of, the lower jaw member 6A and the upper stationary cutter 5A which are illustrated in their relatively closed positions as seen in FIG. 3. The jaw 6A is provided upon the intermeshing jaw surface thereof with a plurality of longitudinally spaced, in the longitudinal direction of the winding strap 3, convex portions 6A′ and concave portions 6A″, while the stationary cutter is similarly provided on the intermeshing jaw surface thereof with a concave portion 5A″ and a plurality of convex portions 5A′ alternatively arranged with respect thereto. It is further appreciated that the convex portions 6A′ of the jaw 6A are disposed opposite or, in effect, in alignment with, the concave portion 5A″, as well as the free region disposed forwardly of cutter 5A, while similarly, the concave portions 6A″ of jaw 6A are disposed opposite to, or, in effect, in longitudinal alignment with, the convex portions 5A′ of cutter 5A, or more accurately, as illustrated, one of the concave portions 6A″ of jaw 6A is disposed opposite one of the convex portions 5A′ of the cutter 5A, while a free region disposed rearwardly of the jaw 6A is disposed opposite another one of the convex portions 5A′ of cutter 5A. It is of course realized that the particular number of convex and concave portions of the jaw 6A and cutter 5A may be varied, as well as their particular intermeshing interrelationship or disposition with respect to each other, the basic concept of the present invention, however, always being maintained to the effect that the intermeshing arrangement of the convex and concave portions of the jaw 6A and the cutter 5A is to be preserved.

As a result of the aforenoted relative disposition of the cutter 5A and the jaw 6A, and the concave and convex portions thereof, it is seen from FIG. 1 that portions of the binding strap 3 are, in effect, pushed upwardly in the directions of the arrows U by means of the convex portions 6A′ of the jaw 6A operatively cooperating with the concave portions 5A″ of the cutter as a result of, in effect, being disposed within such concave portions 5A″ as more particularly seen in FIG. 3, and similarly, other portions of the binding strap 3 are, in effect, pushed downwardly in the directions of the arrows V by means of the convex portions 5A′ of the cutter operatively cooperating with the concave portions 6A″ of the jaw 6A as a result of, in effect, being disposed within such concave portions 6A″. It is further appreciated that the positions denoted by the arrows U and V are alternatively arranged, and in addition, the convex portions of the jaw and cutter act upon opposite surfaces of the binding strap 3 thereby imparting to that portion of the binding strap disposed upstream of the leading end portion 3*a* of the binding strap 3 an undulated or corrugated configuration as considered in the longitudinal direction of the binding strap 3.

As shown in both FIGS. 2 and 4, the gripping means of the present invention comprising the cutter 5A and the jaw 6A with the convex and concave portions 5A′ and 6A′, and 5A″ and 6A″, respectively formed thereon, create convex marks 12U and concave marks 12V upon the upper and lower surfaces of the binding strap 3. As a result of such provision or generation of the aforenoted convex and concave marks 12U and 12V, respectively, upon the opposite surfaces of the binding strap 3, the portion of the binding strap 3 disposed upstream of the leading end portion 3*a* of the strap can be fixedly secured without developing the aforenoted drawbacks, deleterious effects, or deficiencies characterized by the prior art methods and apparatus. Consequently, with that portion of the binding strap 3, disposed upstream of the leading end portion 3*a* of the strap, securely fixed or gripped by means of the gripping jaw 6A and cutter 5A, tension can be applied to the trailing portion 3*b* of the strap 3 by means of the reversely driven drive rollers 4, and with binding strap 3 in this tensioned state, the seal fitment or crimped ferrule 7 can be placed upon the overlapped portions of the binding strap 3 as defined by means of the leading edge portion 3*a* of the strap and the trailing edge portion 3*b* of the strap. In crimping or sealing the fitment or ferrule 7 upon the overlapped portions of the binding strap 3, notches 10 are formed within the side edge portions of the fitment or ferrule 7 as well as the overlapped strap portions. The bonded strap portions are then cut and separated from the residual supply strap portion 3*c* at the location 3*e* by means of a movable cutter 11A operatively cooperating with the still or stationary cutter 5A.

In accordance with the present invention, it is seen that the method of the present invention, and the apparatus or means for carrying out such method, provides improved operations and effects. For example, in accordance with the method of the present invention and the apparatus for carrying out the same, the portion of the strap, which is disposed upstream of the leading end portion 3*a* of the strap 3 and which is gripped by means of the jaw 6A and stationary cutter 5A, is in fact gripped upon both or opposite surfaces thereof, and the gripped locations, upon the opposite surfaces thereof, alternate with each other along the longitudinal direction of the binding strap 3. In this manner, precise location of the gripping means intermeshing tips, or convex and concave portions, across the thickness of the binding strap, is not required because the same effect can be obtained when the convex and concave portions are disposed within predetermined location ranges whereby the convex and concave portions can still operatively interact with each other in the intended manner in order to still achieve the objectives of the present invention.

Still further, the gripping means providing the undulated or corrugated, wave-type form to the gripped strap portion effectively prevents the gripped portion of the binding strap from slipping, even under high-tension, high-torque retractive conditions imposed upon the trailing end or residual portions 3*b* and 3*c* of the binding strap by means of the reversely driven drive rollers 4. In a similar or attendant manner, the undulated or corrugated wave-forms created within the surface regions of the binding strap do not produce any scars or notches which otherwise tend to cause tearing or breakage of the binding strap. Still yet further, in order to achieve the desired gripping operation upon the binding strap in preparation for the tightening, tensioning, and bonding operations, it is not required to grip the strap at as many different locations as was required in connection with conventional methods. Accordingly, the longitudinal extent over which the gripping means is distributed is relatively small and substantially equal to that of the single-grip type gripping means of the prior art whereby the need for large-sized gripping means, and accordingly, a large-sized binding head, is eliminated. Accordingly, still further, a decrease in the residual tension generated within the strap, as would otherwise normally occur upon removal of the large-sized gripping and bonding means from beneath the strap portion disposed upstream of the overlapped strap portions, and within the vicinity of the overlapped strap portions, is effectively prevented, or considered alternatively, the relatively high degree of residual tension within the tensioned bound strap is maintained. In connection with the generation and maintenance of such high degree of tension within the binding strap, it is further noted that the wave-like or corrugated or undulated type gripping configuration increases the resistance of the binding strap against slippage due to the applied tension attendant the binding strap tightening and tensioning operation or process. More particularly, it is also noted that the corrugations or wave-forms developed within the opposite surfaces of the binding strap are also formed within the central portions of the binding strap as considered in connection with the transverse width dimension thereof. Consequently, the lateral side edges of the binding strap are preserved intact whereby tearing, cutting, or the like, which is generally developed within such regions of the binding straps when the straps are utilized in accordance with conventional techniques and apparatus, is effectively prevented thereby increasing the service life of the binding straps, and preventing premature breakage of the same prior to, for example, intentional disengagement of the binding strap from the bound article, even when, for example, external forces are applied to the straps or the bound articles during, for example, transportation thereof.

Obviously, many modifications and variations of the present invention are possible in light of the above teachings. It is therefore to be understood that within the scope of the appended claims, the present invention may be practiced otherwise than as specifically described herein.

I claim:

1. A method for gripping a portion of a binding strap to be used in an article binding operation wherein the strap is supplied from a supply source, encircled about the article to be bound such that a leading end portion of said binding strap is disposed in overlapping relationship with a trailing end portion of said binding strap which, in turn, is integrally connected to a residual supply portion of said binding strap supplied from said supply source, said residual supply portion of said binding strap is retracted while a portion of said binding strap disposed upstream of said leading end portion of said binding strap is securely gripped so as to impart a predetermined amount of tension within said binding strap for securely binding said article to be bound, and wherein said trailing end portion of said binding strap is to be severed by cutting means from said residual supply portion of said binding strap after said overlapped leading and trailing end portions of said binding strap have been bonded to each other so as to bind said article to be bound under tensioned conditions, said method for gripping said portion of said binding strap disposed upstream of said leading end portion of said binding strap comprising the steps of:

providing upon said cutting means at least two laterally spaced convex gripping portions and at least one concave gripping portion interposed and defined between said at least two laterally spaced convex gripping portions;

providing upon a jaw member at least two laterally spaced convex gripping portions and at least one concave gripping portion interposed and defined between said at least two laterally spaced convex gripping portions;

laterally positioning said cutting means and said jaw member such that one of said at least two laterally spaced convex gripping portions of said cutting means is laterally aligned with and disposed within said at least one concave gripping portion of said jaw member, while one of said at least two laterally spaced convex gripping portions of said jaw member is laterally aligned with and disposed within said at least one concave gripping portion of said cutting means;

inserting said portion of said binding strap disposed upstream of said leading end portion of said binding strap between said convex and concave gripping portions of said cutting means and said jaw member; and moving said cutting means and said jaw member relatively toward each other such that said convex and concave gripping portions of said cutting means and said jaw member grip said portion of said binding strap disposed upstream of said leading end portion of said binding strap in an undulated manner so as to securely grip said portion of said binding strap disposed upstream of said leading end portion of said binding strap while said binding strap is being tensioned.

2. A method as set forth in claim 1, wherein:

said cutting means is a stationary cutting component operatively cooperative with a movable cutting component, and said jaw member is a movable jaw member which is moved toward said stationary cutting component so as to securely grip said portion of said binding strap disposed upstream of said leading end portion of said binding strap.

3. A method as set forth in claim 1, wherein:

said convex and concave gripping portions of said cutting means and said jaw members are laterally spaced with respect to each other along the longitudinal extent of said binding strap as defined between said leading and trailing end portions of said binding strap.

4. Apparatus for gripping a portion of a binding strap to be used in an article binding operation wherein the strap is supplied from a supply source, encircled about the article to be bound such that a leading end portion of said binding strap is disposed in overlapping relationship with a trailing end portion of said binding strap which, in turn, is integrally connected to a residual supply portion of said binding strap supplied from said supply source, said residual supply portion of said binding strap is retracted while a portion of said binding strap disposed upstream of said leading end portion of said binding strap is securely gripped so as to impart a predetermined amount of tension within said binding strap for securely binding said article to be bound, and wherein said trailing end portion of said binding strap is to be severed from said residual supply portion of said binding strap after said overlapped leading and trailing end portions of said binding strap have been bonded to each other so as to bind said article to be bound under tensioned conditions, said apparatus for gripping said portion of said binding strap disposed upstream of said leading end portion of said binding strap comprising:

cutting means, for severing said trailing end portion of said binding strap from said residual supply portion of said binding strap, having at least two laterally spaced convex gripping portions and at least one concave gripping portion interposed and defined between said at least two laterally spaced convex gripping portions;

a jaw member having at least two laterally spaced convex gripping portions and at least one concave gripping portion interposed and defined between said at least two laterally spaced convex gripping portions;

means for laterally positioning said cutting means and said jaw member such that one of said at least two laterally spaced convex gripping portions of said cutting means is laterally aligned with and disposed within said at least one concave gripping portion of said jaw member, while one of said at least two laterally spaced convex gripping portions of said jaw member is laterally aligned with and disposed within said at least one concave gripping portion of said cutting means;

means for inserting said portion of said binding strap disposed upstream of said leading end portion of said binding strap between said convex and concave gripping portions of said cutting means and saw jaw member; and means for moving said cutting means and said jaw member relative to each other such that said convex and concave gripping portions of said cutting means and said jaw member grip said portion of said binding strap disposed upstream of said leading end portion of said binding strap in an undulated manner so as to securely grip said portion of said binding strap disposed upstream of said leading end portion of said binding strap while said binding strap is being tensioned.

5. Apparatus as set forth in claim 4, wherein:

said cutting means is a stationary cutting component operatively cooperative with a movable cutting component; and said jaw member is a movable jaw member which is moved toward said stationary cutting component so as to securely grip said portion of said binding strap disposed upstream of said leading end portion of said binding strap.

6. Apparatus as set forth in claim 4, wherein:

said convex and concave gripping portions of said cutting means and said jaw member are laterally spaced with respect to each other along the longitudinal extent of said binding strap as defined between said leading and trailing end portions of said binding strap.

* * * * *